US010836011B2

(12) United States Patent
Mao et al.

(10) Patent No.: US 10,836,011 B2
(45) Date of Patent: Nov. 17, 2020

(54) SINGLE-POINT DIAMOND DRESSER FOR GRINDING WHEEL BASED ON ACOUSTIC EMISSION ONLINE MONITORING

(71) Applicant: Changsha University of Science and Technology, Hunan (CN)

(72) Inventors: Cong Mao, Hunan (CN); Yongle Hu, Hunan (CN); Linfeng Xiao, Hunan (CN); Kun Tang, Hunan (CN); Mingjun Zhang, Hunan (CN); Zhikang Zhang, Hunan (CN); Lairong Yin, Hunan (CN)

(73) Assignee: Changsha University of Science and Technology, Changsha (CN)

( * ) Notice: Subject to any disclaimer, the term of this patent is extended or adjusted under 35 U.S.C. 154(b) by 0 days.

(21) Appl. No.: 16/740,436

(22) Filed: Jan. 11, 2020

(65) Prior Publication Data

US 2020/0147755 A1 May 14, 2020

Related U.S. Application Data

(63) Continuation of application No. PCT/CN2019/097074, filed on Jul. 22, 2019.

(30) Foreign Application Priority Data

Jul. 22, 2019 (CN) ..... CN2019/097074

(51) Int. Cl.
*B24B 53/047* (2006.01)
*B24B 53/095* (2006.01)
(Continued)

(52) U.S. Cl.
CPC ..... *B24B 53/047* (2013.01); *B24B 49/003* (2013.01); *B24B 49/10* (2013.01);
(Continued)

(58) Field of Classification Search
CPC ..... B24B 49/003; B24B 49/10; B24B 49/18; B24B 53/001; B24B 53/047; B24B 53/095; B24B 55/02
(Continued)

(56) References Cited

U.S. PATENT DOCUMENTS 4,821,460 A * 4/1989 Wegmann ..... B23Q 15/225 409/141
5,618,221 A * 4/1997 Furukawa ..... B24B 49/18 451/10
(Continued)

FOREIGN PATENT DOCUMENTS

CN 101659038 A 3/2010
CN 102621226 A 8/2012
(Continued)

*Primary Examiner* — Eileen P Morgan
(74) *Attorney, Agent, or Firm* — Wayne & Ken, LLC; Tony Hom

(57) ABSTRACT

The present application discloses a single-point diamond dresser for a grinding wheel based on acoustic emission online monitoring, which includes a support module, an anti-interference module, a compression cooling module and an acoustic emission online monitoring module. An acoustic emission sensor monitors the dressing state of the grinding wheel online; a damping sheet and a damping interlayer greatly reduce external noise interference; a high pressure coolant causes an upward elastic deformation of an elastic spacer and the damping sheet, enlarging a contact force between the acoustic emission sensor and the core and moreover improving a sensitivity of the acoustic emission sensor; the coolant flows through the coolant passages in the core to cool a dressing area; current limiting passages, pressure relief cavities and perforated pressure-relief plates limit flow and reduce a pressure of the coolant, reducing the interference of the coolant on the grinding wheel dressing.

5 Claims, 2 Drawing Sheets

(51) Int. Cl.

| | |
|---|---|
| ***B24B 55/02*** | (2006.01) |
| ***B24B 49/10*** | (2006.01) |
| ***B24B 49/18*** | (2006.01) |
| ***B24B 53/00*** | (2006.01) |
| ***B24B 49/00*** | (2012.01) |

(52) U.S. Cl.
CPC ..... *B24B 49/18* (2013.01); *B24B 53/001* (2013.01); *B24B 53/095* (2013.01); *B24B 55/02* (2013.01)

(58) Field of Classification Search
USPC ..... 451/5, 9, 10, 11, 21, 56, 443
See application file for complete search history.

(56) References Cited

U.S. PATENT DOCUMENTS

| | | | | |
|---|---|---|---|---|
| 7,377,170 | B2 | 5/2008 | Ganesan et al. | |
| 2002/0037681 | A1 | 3/2002 | Gitis | |
| 2009/0042483 | A1 | 2/2009 | Meki | |
| 2012/0190274 | A1* | 7/2012 | Ito | B24B 53/085 451/11 |
| 2012/0238185 | A1* | 9/2012 | Yanase | B24B 53/075 451/1 |
| 2020/0147755 | A1* | 5/2020 | Mao | B24B 53/095 |

FOREIGN PATENT DOCUMENTS

| | | | |
|---|---|---|---|
| CN | 103273423 | A | 9/2013 |
| KR | 960040561 | A | 12/1996 |

* cited by examiner

SINGLE-POINT DIAMOND DRESSER FOR GRINDING WHEEL BASED ON ACOUSTIC EMISSION ONLINE MONITORING

CROSS-REFERENCE TO RELATED APPLICATIONS

This application is a continuation of International Application No. PCT/CN2019/097074, filed on Jul. 22, 2019, which claims the benefit of priority from Chinese Patent Application No. 201811182455.4, filed on Oct. 11, 2018. The content of the aforementioned applications, including any intervening amendments thereto, is incorporated herein by reference.

TECHNICAL FIELD

This application relates to a single-point diamond dresser for a grinding wheel, and more particularly to a single-point diamond dresser for a grinding wheel based on acoustic emission online monitoring.

BACKGROUND OF THE INVENTION

In a precision grinding process, dressers are usually required to dress grinding wheels to avoid a reduced processing quality caused by grinding wheel wear. However, in a practical manufacturing process, a dressing quality of the grinding wheel is generally determined by experience of workers, so the dressing allowance is intentionally increased to ensure the dressing quality. Obviously, this method is extremely dependent on the experience of workers, and also reduces the dressing efficiency. Ideally, it is effective to determine the dressing quality of the grinding wheel by online monitoring the dressing force. However, the dressing force is generally very small and has many external interference signals, resulting in fewer effective criteria for determining the dressing quality of the grinding wheel.

As is well-known, acoustic emission online monitoring has extremely high sensitivity and fast response; therefore the acoustic emission signal is widely used as a signal source for online monitoring of wheel dressing. Researches show that generally, the signal of the acoustic emission source is extremely weak and the amplitude of the acoustic wave will gradually decay as the propagation distance increases during the propagation process. For contact-type acoustic emission sensors, because of the high density of solids and low attenuation of acoustic waves therein, solids are widely used as acoustic wave propagation media. Therefore, sensitive components of the sensor can get stronger excitation and generate stronger electrical signals. Meanwhile, it is necessary to maintain a large pressure between the acoustic emission sensor and the excitation source and minimize interference of other noise on the effective signal of the acoustic emission sensor.

Besides, the dressing quality of the grinding wheel is closely related to the cutter state of the single-pointed diamond dressing pen. During a dressing process of the grinding wheel, the single-pointed diamond dressing pen continuously contacts and rubs with the rotating grinding wheel, resulting in high temperature of the single-pointed diamond dressing pen. If the single-pointed diamond dressing pen is not cooled, thermal damage will be caused, which will further affect the dressing quality of the grinding wheel.

SUMMARY OF THE INVENTION

An object of the invention is to overcome the above-mentioned problems and to disclose a single-point diamond dresser for a grinding wheel based on acoustic emission online monitoring, which comprises a support module, an anti-interference module, a compression cooling module and an acoustic emission online monitoring module. The supporting module mainly supports the device. The anti-interference module greatly reduces noise interference on effective signals of an acoustic emission sensor. The compression cooling module significantly increases a contact force between the acoustic emission sensor and the core, improving a sensitivity of the acoustic emission sensor, and at the same time sufficiently cools a dressing area of the grinding wheel. The acoustic emission online monitoring module converts the acoustic emission signal generated during dressing the grinding wheel to an electric signal, and the electric signal is transmitted to an external preamplifier via the wire, realizing the online monitoring of the dressing state of the grinding wheel. The invention has beneficial effects of improving the sensitivity of the acoustic emission sensor, preventing thermal damage of the single-point diamond, reducing loss of the acoustic emission signal and improving an anti-interference ability.

To achieve the above-mentioned object, provided is a single-point diamond dresser for a grinding wheel based on acoustic emission online monitoring, comprising a support module, an anti-interference module, a compression cooling module and an acoustic emission online monitoring module;

wherein the support module comprises a casing, a core and a waterproof sleeve; the waterproof sleeve is installed at the casing, threads are provided on an inner wall of the waterproof sleeve to connect to an external cooling pipe; the casing and the core are connected via bolts; a single-point diamond dressing pen is embedded in the core and is configured to dress the grinding wheel;

the anti-interference module comprises a damping sheet and a damping interlayer; the damping sheet is mainly configured to eliminate noise interference of a coolant on effective signals of an acoustic emission sensor; a first groove is provided at a middle of the damping sheet for inlaying the acoustic emission sensor, and a second groove is provided near an outer edge of the damping sheet for inlaying an elastic spacer; the damping interlayer is mounted in the casing and is mainly configured to eliminate interference of a vibration noise of a grinder and external environmental noise on the effective signals of the acoustic emission sensor;

the compression cooling module comprises a container, a plurality of coolant passages and the elastic spacer; the elastic spacer is bonded to the core; after the coolant enters the container by flowing through the waterproof sleeve, an upward pressure is applied onto a lower surface of the damping sheet, resulting in an upward elastic deformation of the elastic spacer and the damping sheet, so that the acoustic emission sensor is compressed to increase a contact force between the acoustic emission sensor and the core, improving a sensitivity of the acoustic emission sensor; the coolant flows through the coolant passages in the core to cool a dressing area of the grinding wheel;

the acoustic emission online monitoring module comprises the acoustic emission sensor, a wire and a flexible pipe; the acoustic emission sensor is embedded in the first groove of the damping sheet; an upper surface of the acoustic emission sensor contacts the core with Vaseline as an acoustic coupling agent; the acoustic emission sensor converts the acoustic emission signal generated during dressing the grinding wheel to an electric signal, and the electric signal is transmitted to an external preamplifier via the wire; the wire is arranged in the flexible pipe; the flexible pipe, a first seal ring and a second seal ring are configured for waterproof sealing.

The number of the coolant passages is 3~6, and the coolant passages are circumferentially arranged along a center line of the core; each of the coolant passages comprises a current limiting passage and a pressure relief cavity; the current limiting passage has a diameter of a few millimeters, and threads are provided on an inner wall of the pressure relief cavity to connect with a perforated pressure-relief plate which has at least one layer; the perforated pressure-relief plate has a web frame structure, and holes are provided on a web frame which is provided with threads at an outer edge; an inner hexagonal blind hole is provided on a middle of the web frame for assembling and disassembling; the current limiting passage limits flow of the coolant; the holes on the perforated pressure-relief plate reduce a pressure for the high-pressure coolant which flows through the coolant passages; a sectional area of the pressure relief cavity is much larger than a sectional area of the current limiting passage, and a pressure of the high-pressure coolant is greatly reduced after flowing through the coolant passages, so that an interference of the high-pressure coolant on dressing of the grinding wheel is effectively reduced, and the dressing area is fully cooled.

The damping sheet is made of polyurethane, and a base area of the damping sheet is 80%-90% of a base area of the core.

The elastic spacer is made of rubber.

The casing and the core are connected via 4~6 bolts; and the damping interlayer is made of quartz wool.

The current limiting passage has a diameter of 1~3 mm.

Compared with the prior art, the single-point diamond dresser for grinding wheel based on acoustic emission online monitoring has the following beneficial effects.

(1) The invention improves the sensitivity of the acoustic emission sensor. The elastic spacer is made of rubber with extremely low elastic modulus and the damping sheet is made of polyurethane with larger elasticity. Under the pressure of the coolant, the elastic spacer is compressed and the damping sheet generates an upward elastic deformation, thus the contact force between the acoustic emission sensor and the core is significantly increased and the sensitivity of the acoustic emission sensor is significantly improved.

(2) The invention prevents the thermal damage of the single-point diamond effectively. Based on the reliable acoustic emission online monitoring, a novel cooling system is provided in the invention, in which the current limiting passage limits flow of the coolant, and the pressure loss of the perforated pressure-relief plate and a sudden increase of the sectional area of the pressure relief cavity significantly reduce the pressure of the high-pressure coolant. Then the interference of the high pressure coolant on the dressing of the grinding wheel is effectively reduced, and at the same time the dressing area is fully cooled, effectively preventing the thermal damage of the single-point diamond and further greatly improving the service life of the dresser.

(3) The invention significantly reduces loss of the acoustic emission signal. In this invention, the acoustic emission sensor and the acoustic emission source are arranged to be extremely close, and propagation mediums thereof are both solids. At the same time, Vaseline is used as the acoustic coupling agent, so the acoustic waves has very little attenuation during propagation and a high signal-to-noise ratio.

(4) The invention greatly improves the anti-interference ability. The damping interlayer is installed in the casing and mainly eliminates interference of a vibration noise of a grinder and external environmental noise on the effective signals of the acoustic emission sensor. Meanwhile, the damping sheet is arranged close to the acoustic emission sensor and mainly eliminates interference of coolant noise on the effective signals of the acoustic emission sensor, so the anti-interference ability is greatly improved.

Figure 1:
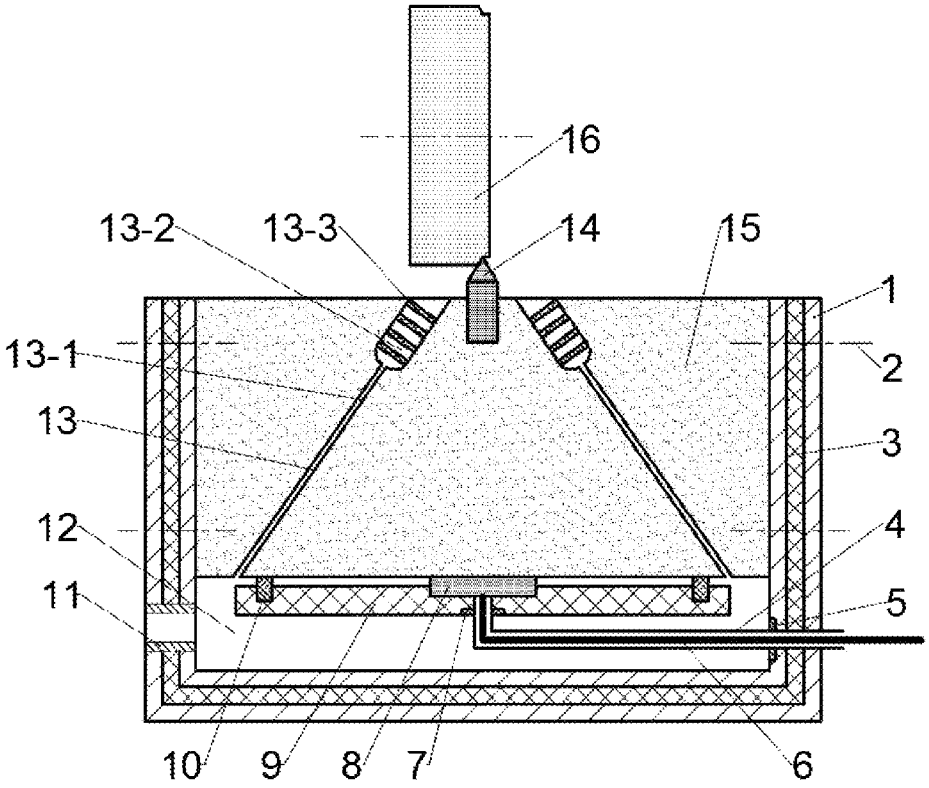
FIG. 1 is a schematic diagram of a single-point diamond dresser for a grinding wheel based on acoustic emission online monitoring according to the present invention.
Figure 2:
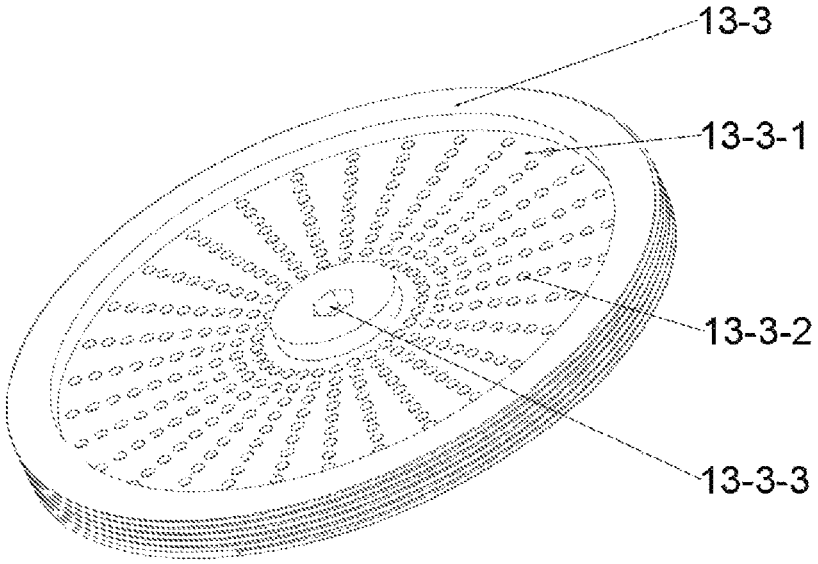
FIG. 2 is a schematic diagram of a perforated pressure-relief plate according to the present invention.
Figure 3:
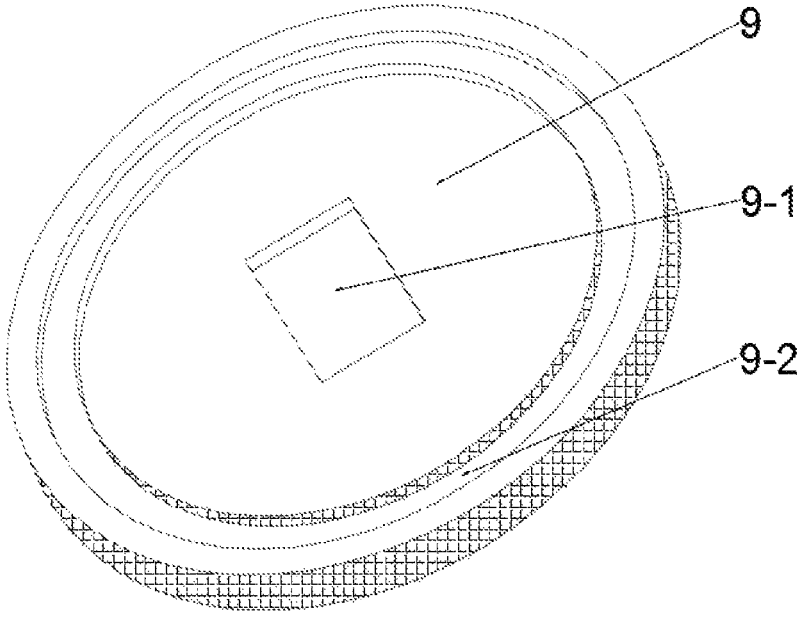
FIG. 3 is a schematic diagram of a damping sheet according to the present invention.

In the drawings, 1, casing, 2—bolt; 3, damping interlayer; 4, flexible pipe; 5, first seal ring; 6, wire; 7, second seal ring; 8, acoustic emission sensor; 9, damping sheet; 9-1, first groove; 9-2, second groove; 10, elastic spacer; 11, waterproof sleeve; 12, container; 13, coolant passage; 13-1, current limiting passage; 13-2, pressure relief cavity; 13-3, perforated pressure-relief plate; 13-3-1, web frame; 13-3-2, hole; 13-3-3, inner hexagonal blind hole; 14, single-point diamond dressing pen; 15, core; 16, grinding wheel.

DETAILED DESCRIPTION OF EMBODIMENTS

The technical solutions of the present invention are described with reference to the accompanying drawings as follows.

The invention provides a single-point diamond dresser for a grinding wheel based on acoustic emission online monitoring, which includes a support module, an anti-interference module, a compression cooling module and an acoustic emission online monitoring module.

The support module includes a casing 1, a core 15 and a waterproof sleeve 11; the anti-interference module includes a damping sheet 9 and a damping interlayer 3; the compression cooling module includes a container 12, coolant passages 13 and an elastic spacer 10; the acoustic emission online monitoring module includes an acoustic emission sensor 8, a wire 6 and a flexible pipe 4.

The waterproof sleeve 11 is installed at the casing 1, threads are provided on an inner wall of the waterproof sleeve 11 to connect to an external cooling pipe; the casing 1 and the core 15 are connected via four bolts 2; a single-point diamond dressing pen 14 is embedded in the core 15 and is configured to dress the grinding wheel 16.

The damping sheet 9 is made of polyurethane and is mainly configured to eliminate noise interference of a coolant on the effective signals of the acoustic emission sensor, and a base area of the damping sheet is 85% of a base area of the core 15. A first groove 9-1 is provided at a middle of the damping sheet 9 for inlaying the acoustic emission sensor 8, and a second groove 9-2 is provided near an outer edge of the damping sheet 9 for inlaying the elastic spacer 10; the damping interlayer 3 made of quartz wool is mounted in the casing 1 and is mainly configured to eliminate interference of a vibration noise of a grinder and external environmental noise on the effective signals of the acoustic emission sensor 8.

The elastic spacer 10 made of rubber is bonded to the core 15; after the coolant enters the container 12 by flowing through the waterproof sleeve 11, an upward pressure is applied onto a lower surface of the damping sheet 9, resulting in an upward elastic deformation of the elastic spacer 10 and the damping sheet 9, so that the acoustic emission sensor 8 is compressed to increase a contact force between the acoustic emission sensor 8 and the core 15, improving a sensitivity of the acoustic emission sensor 8; the coolant flows through the coolant passages 13 in the core 15 to cool a dressing area of the grinding wheel 16.

There are four coolant passages 13 circumferentially arranged along a center line of the core 15; each of the coolant passages 13 comprises a current limiting passage 13-1 and a pressure relief cavity 13-2; the current limiting passage 13-1 has a diameter of a 2 mm, and threads are provided on an inner wall of the pressure relief cavity 13-2 to connect with a perforated pressure-relief plate 13-3 which has four layers; the perforated pressure-relief plate 13-3 has a web frame structure, and holes 13-3-2 are provided on a web frame 13-3-1 which is provided with threads at an outer edge; an inner hexagonal blind hole 13-3-3 is provided on a middle of the web frame 13-3-1 for assembling and disassembling; the current limiting passage 13-1 limits flow of the coolant; the holes 13-3-2 on the perforated pressure-relief plate 13-3 reduce a pressure for the high-pressure coolant which flows through the coolant passage 13; a sectional area of the pressure relief cavity 13-2 is much larger than a sectional area of the current limiting passage 13-1, and a pressure of the high-pressure coolant in container 12 is greatly reduced after flowing through the coolant passages 13, so that an interference of the high-pressure coolant on dressing of the grinding wheel 16 is effectively reduced, and the dressing area is fully cooled.

The acoustic emission sensor 8 is embedded in the first groove 9-1 of the damping sheet 9; an upper surface of the acoustic emission sensor 8 contacts the core 15 with Vaseline as an acoustic coupling agent; the acoustic emission sensor 8 converts the acoustic emission signal generated during dressing the grinding wheel 16 to an electric signal, and the electric signal is transmitted to an external preamplifier via the wire 6; the wire 6 is arranged in the flexible pipe 4; the flexible pipe 4, a first seal ring 5 and a second seal ring 7 are configured for waterproof sealing.

The above is merely preferred embodiment for detailed illustration of the object, technical solutions and beneficial effects of the invention and is not intended to limit the invention. Any equivalent replacements and modifications made within the scope of the invention shall all fall within the scope of the invention.

What is claimed is:

1. A single-point diamond dresser for a grinding wheel based on acoustic emission online monitoring, comprising:

a support module, an anti-interference module, a compression cooling module, and an acoustic emission online monitoring module;

wherein the support module comprises a casing, a core and a waterproof sleeve; the waterproof sleeve is installed at the casing; threads are provided on an inner wall of the waterproof sleeve to connect to an external cooling pipe; the casing and the core are connected via bolts; a single-point diamond dressing pen is inlaid in the core and is configured to dress the grinding wheel;

the anti-interference module comprises a damping sheet and a damping interlayer; the damping sheet is mainly configured to eliminate noise interference of a coolant on effective signals of an acoustic emission sensor; a first groove is provided at a middle of the damping sheet for inlaying the acoustic emission sensor, and a second groove is provided near an outer edge of the damping sheet for inlaying an elastic spacer; the damping interlayer is mounted in the casing and is mainly configured to eliminate interference of a vibration noise of a grinder and external environmental noise on the effective signals of the acoustic emission sensor;

the compression cooling module comprises a container, a plurality of coolant passages and the elastic spacer; the elastic spacer is bonded to the core; after the coolant enters the container by flowing through the waterproof sleeve, an upward pressure is applied onto a lower surface of the damping sheet, resulting in an upward elastic deformation of the elastic spacer and the damping sheet, so that the acoustic emission sensor is compressed to increase a contact force between the acoustic emission sensor and the core, improving a sensitivity of the acoustic emission sensor; the coolant flows through the coolant passages in the core to cool a dressing area of the grinding wheel;

The acoustic emission online monitoring module comprises the acoustic emission sensor, a wire and a flexible pipe; the acoustic emission sensor is inlaid in the first groove of the damping sheet; an upper surface of the acoustic emission sensor contacts the core with Vaseline as an acoustic coupling agent; the acoustic emission sensor converts an acoustic emission signal generated during dressing the grinding wheel to an electric signal, and the electric signal is transmitted to an external preamplifier via the wire; the wire is arranged in the flexible pipe; the flexible pipe, a first seal ring and a second seal ring are configured for waterproof sealing.

2. The single-point diamond dresser claim 1, wherein the number of the coolant passages is 3~6, and the coolant passages are circumferentially arranged along a center line of the core; each of the coolant passages comprises a current limiting passage and a pressure relief cavity; the current limiting passage has a diameter of 1-3 millimeters, and threads are provided on an inner wall of the pressure relief cavity to connect with a perforated pressure-relief plate which has at least one layer; the perforated pressure-relief plate has a web frame structure, and holes are provided on a web frame which is provided with threads at an outer edge; an inner hexagonal blind hole is provided on a middle of the web frame for assembling and disassembling; the current limiting passage limits flow of the coolant; the holes on the perforated pressure-relief plate reduce a pressure of the high-pressure coolant which flows through the coolant passages; a sectional area of the pressure relief cavity is much larger than a sectional area of the current limiting passage, and a pressure of the high-pressure coolant is greatly reduced after flowing through the coolant passages, so that interference of the high-pressure coolant on dressing of the grinding wheel is effectively reduced, and the dressing area is fully cooled.

3. The single-point diamond dresser of claim 1, wherein the damping sheet is made of polyurethane, and a base area of the damping sheet is 80%-90% of a base area of the core.

4. The single-point diamond dresser of claim 1, wherein the elastic spacer is made of rubber.

5. The single-point diamond dresser of claim 1, wherein the casing and the core are connected via 4~6 bolts; and the damping interlayer is made of quartz wool.

* * * * *